United States Patent [19]

Bullock, III

[11] Patent Number: 4,844,268

[45] Date of Patent: Jul. 4, 1989

[54] TAMPER-EVIDENT CAP AND NECK STRUCTURE

[75] Inventor: Joseph J. Bullock, III, Atherton, Calif.

[73] Assignee: Cap Snap Co., San Jose, Calif.

[21] Appl. No.: 180,392

[22] Filed: Apr. 12, 1988

Related U.S. Application Data

[63] Continuation-in-part of Ser. No. 101,261, Sep. 25, 1987, Pat. No. 4,815,620.

[51] Int. Cl.[4] ..... B65D 41/46

[52] U.S. Cl. ..... 215/256

[58] Field of Search ..... 215/256

[56] References Cited

U.S. PATENT DOCUMENTS

| | | | |
|---|---|---|---|
| 3,073,472 | 1/1963 | Williams | 215/256 |
| 3,434,613 | 3/1969 | Langecker | 215/256 |
| 3,940,004 | 2/1976 | Faulstich | 215/256 |
| 4,166,552 | 9/1979 | Faulstich | 215/256 |
| 4,305,517 | 12/1981 | Dennis | 215/256 |
| 4,307,821 | 12/1981 | McIntosh | 215/256 X |
| 4,387,818 | 6/1983 | Conti | 215/256 |
| 4,561,553 | 12/1985 | Crisci | 215/256 |
| 4,589,561 | 5/1986 | Crisci | 215/256 |
| 4,593,830 | 6/1986 | Bullock | 215/256 |
| 4,667,839 | 5/1987 | Crisci | 215/256 |
| 4,676,389 | 6/1987 | Bullock | 215/256 X |
| 4,699,287 | 10/1987 | Bullock | 215/256 |
| 4,700,860 | 10/1987 | Li | 215/256 |

FOREIGN PATENT DOCUMENTS

| | | | |
|---|---|---|---|
| 954475 | 9/1974 | Canada | 215/256 |
| 1137029 | 12/1982 | Canada | 215/256 |
| 1393366 | 2/1965 | France | 215/256 |

*Primary Examiner*—Donald F. Norton

*Attorney, Agent, or Firm*—Julian Caplan

[57] ABSTRACT

A plastic cap for a container neck formed with upper and lower external locking beads has a top disk from which depends an upper outer skirt having an upper internal locking bead and a larger diameter lower skirt having a lower internal locking bead. Between the skirt sections is an external outward extending flange which is weakened by a notch cut in its outer corner. The interior of the skirt is formed with an outward extending shoulder at a lower elevation than said external outward extending flange and the lower skirt wall intersects said outward extending shoulder in a circular intersection. A circumferential line of minimum thickness extends downward-inward from said notch to said line of intersection. When the cap is seated on the neck the upper and lower beads interengage, the cap cannot be removed without evidence of tampering. To fracture the flange at the line of minimum thickness, a tear tab depends from the lower edge of the skirt and a curved score line at the upper end of the tear tab extends up from the lower edge of the skirt to the level of the line of minimum thickness. Pulling the tab tears the skirt at the curved score line and around the line of minimum thickness, removing all or a sufficient portion of the lower skirt and its lower internal locking bead.

6 Claims, 2 Drawing Sheets

TAMPER-EVIDENT CAP AND NECK STRUCTURE

RELATED APPLICATION

This application is a continuation-in-part of co-pending application Ser. No. 101,261, filed Sept. 25, 1987 now U.S. Pat. No. 4,815,620.

FIELD OF THE INVENTION

This invention relates to a new and improved tamper-evident cap having a top disk from which depend upper and lower outer skirts having upper and lower locking beads respectively which lock under cooperating external beads on the bottle neck. In one form of the invention, the inner skirt or plug is omitted. The invention is characterized by the fact that the lower part of the skirt is of larger diameter than the upper and the junction between the two comprises a notched flange which is formed with a line of minimum thickness which slants downward inward. The skirt of the cap may be broken away at the line of minimum thickness to remove the lower skirt and its lower locking bead, thereby making it possible to remove the cap from the neck.

DESCRIPTION OF RELATED ART

The neck shown in the accompanying drawings resembles a commercially available neck of the type shown in U.S. Pat. No. 4,667,839. Necks with upward-inward slanted lip flanges are shown in U.S. Pat. No. 4,496,066. Plural diameter cap skirts which are frangible in a line of weakness between the two diameters are shown in numerous prior patents such as Li U.S. Pat. No. 4,700,860.

SUMMARY OF THE INVENTION

The cap of the present invention is shaped to engage with a thin-walled blow molded plastic bottle neck of the type used for milk and bottled water having a neck formed with an inward turned flange at its upper end and having upper and lower external locking beads, the lower locking bead being radially offset outward relative to the upper bead. In one form of the invention, the cap has a top disk from which depend outer and inner skirts, the space between the skirts being equal to or less than the width of the top flange of the neck. The outer skirt has an internal locking bead positioned to seat under the external locking bead of the neck. Below the top internal locking bead is a flange and below the flange is a lower skirt portion of a diameter greater than that of the upper skirt portion. The bottom edge of the lower skirt portion seats on the shoulder of the bottle neck. On the lower skirt portion is an internal locking bead which seats under the lower external locking bead of the neck. The cap is formed so there is a downward-inward inclined line of minimum thickness between the upper and lower skirt portions.

In another form of the invention, the inner skirt or plug is omitted and a foil disk liner is used.

There is a tear tab depending on the lower end of the skirt adjacent an in-turned curved score line. By pulling upward on the tear tab and along the curved score line and along the line of minimum thickness, the lower skirt and its lower locking bead may be torn away. Thereafter the upper skirt portion may be pried off the cap without undue effort, whereas when the lower skirt is intact it is virtually impossible to pry the cap off the neck.

It is a feature of the invention that the line of minimum thickness slants downwardly inwardly between a notch formed on the horizontal shoulder or flange which extends outwardly from the upper skirt portion to a line around the upper edge of the lower skirt portion.

One feature of the preferred embodiment of the invention is the fact that the lower internal sealing bead of the cap is at the lower edge of the skirt. The slanted lower flank of the bead guides the cap onto proper position on the neck. In fact, in common capping machines where the containers pass under the lower end of a chute down which the caps slide, the leading edge of the upper edge of the upward-inward slanted lip of the neck hooks the lower bead, thereby pulling the cap out of the chute so that if falls into place on the neck.

The positioning of the bead on the lower end of the skirt prevents caps from stacking. Thus the caps are properly fed from the hopper of the capping machine into the delivery chute.

The lower bead being on the edge of the skirt prevents miscapping in that it prevents the lower edge of the skirt from rolling up when capping commences before the cap is properly seated on the neck of the container.

Other objects of the present invention will become apparent upon reading the following specification and referring to the accompanying drawings in which similar characters of reference represent corresponding parts in each of the several views.

DESCRIPTION OF PREFERRED EMBODIMENTS

Figure 1:
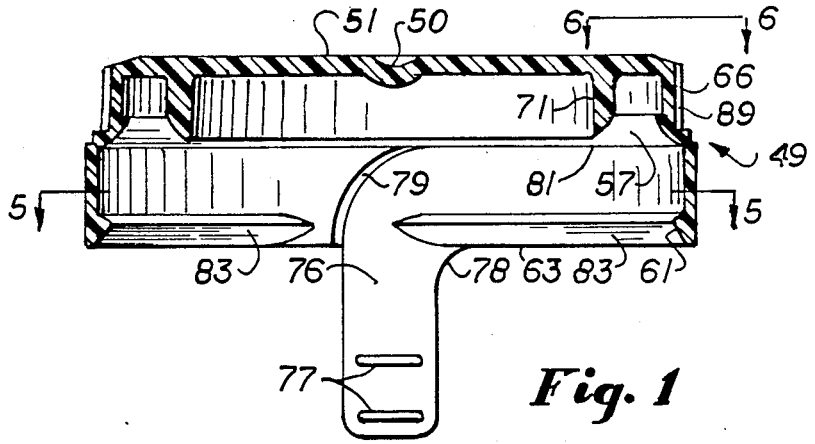
FIG. 1 is a vertical sectional view of one cap made in accordance with the present invention.
Figure 2:
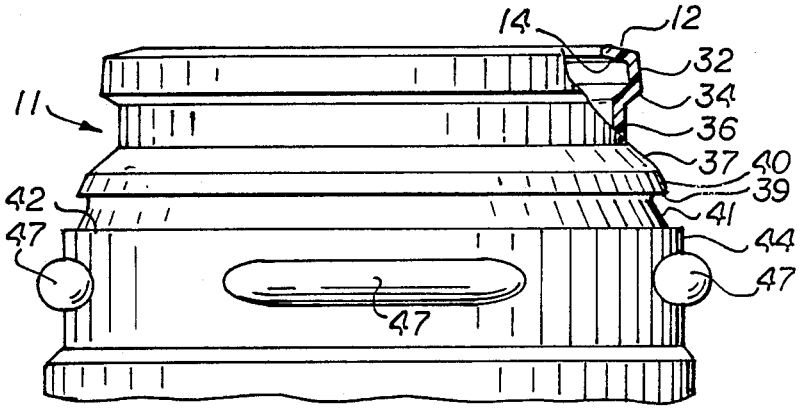
FIG. 2 is a side elevational of a neck to be used with said cap partially broken away in section to reveal internal construction.
Figure 6:
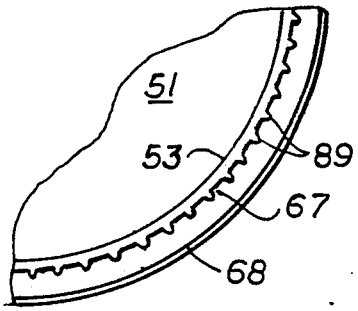
FIG. 6 is a fragmentary top plan of a portion of the cap as viewed along line 6—6 of FIG. 1.
Figure 5:
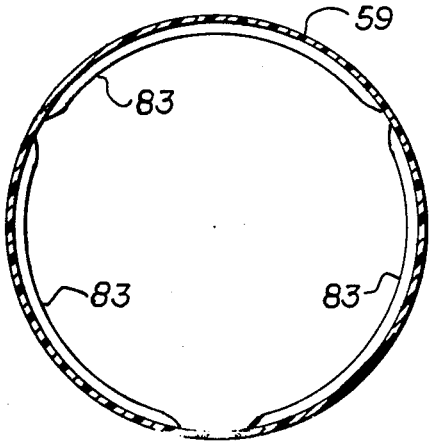
FIG. 5 is a sectional view taken substantially along line 5—5 of FIG. 1.

The container neck 11 resembles a commercially available neck with an important modification. Neck 11 has a top lip or flange 12 slanted upwardly inwardly at an angle of about 10° to the horizontal, the lip 12 having an inner edge 13. Describing now the interior of the neck, the underside 14 of flange 12 slants downward outward and joins a downward-outward stretch 16 which is disposed at about 10° from the vertical. There is a curved corner 17 on the lower end of stretch 16 which merges into a substantially vertical stretch 18 which, in turn, merges with a downward-outward stretch 19. Knuckle 21 curves inward at the lower end of stretch 19. Below knuckle 21 the inner wall slants downward outward at an angle of 55° to the horizontal in a stretch 22. A vertical stretch 23 below stretch 22 merges with a vertical stretch 27. Bumper ring arcuate segments 24 of about 45° arcuate length bulge out in semicircular contour from stretch 27. The shape of the neck below stretch 27 is not of significance in an understanding of the present invention.

Directing attention now to the exterior of neck 11 the slanted upper surface of lip 12 terminates in a corner 31 and below the corner 31 is a downward-outward inclined stretch 32 disposed at an angle of about 10° to the vertical. At the lower end of stretch 32 is a substantially horizontal first shoulder 33, the surfaces 32 and 33 defining an upper external locking bead 34. Below shoulder 33 is a substantially vertical stretch 36 which is parallel to stretch 18. Chamfer 35 is formed at the intersection of surfaces 33 and 36. Stretch 36 terminates at its lower end in an outward-downward stretch 37 disposed at an angle of about 40° to the horizontal. A 60° to the horizontal surface 40 is located at the lower end of surface 37. At the lower end of surface 40 is a second substantially horizontal shoulder 38 which gives way to a stretch 41 slanted downward-outward at an angle of 55° to the horizontal. At the lower end of stretch 41 is a horizontal shoulder 42. Surfaces 40 and 42 define lower neck bead 39. Below shoulder 42 is a vertical stretch 44. Bumper ring segments 47 of 45° length protrude from surfaces 44 and are adapted to be gripped by fingers of equipment for filling and loading the container as is well understood in the art.

Figure 7:
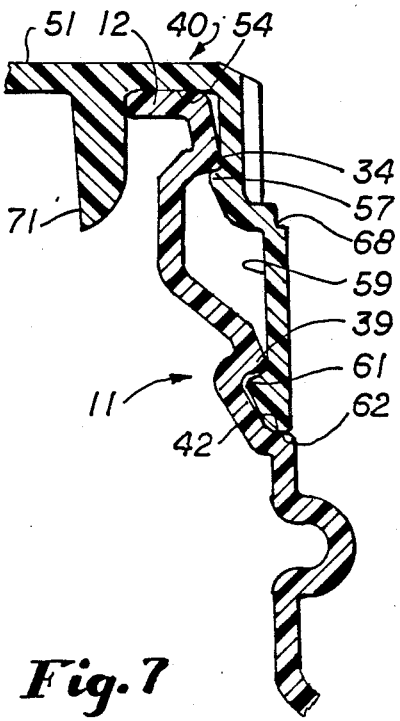
FIG. 7 is a fragmentary sectional view showing the cap of FIG. 3 seated on the neck of FIG. 4.

Directing attention now to cap 49 shown in FIGS. 1–6, there is a top disk 51 having a central indentation or dimple 50 and having a chamfered outer edge 53. The underside 54 of disk 51 is dimensioned so that the upper surface of lip 12 seals thereagainst as best shown in FIG. 7.

Cap 49 has an outer skirt which comprises an internal vertical stretch 53 and on the lower end thereof is an upper internal locking bead 57 having a horizontal top shoulder 55 continuous around the inside of the surface 56. Below shoulder 55, bead 57 slants downward-outward at an angle in stretch 81 and then curves in a radius 58 to a narrow horizontal shoulder 82.

However, it will be understood that the bead 57 may assume other cross-sectional shapes and may be interrupted rather than continuous. Below curved surface 58 is a substantially vertical stretch 59 and on the lower end thereof is a lower internal locking bead 61 which is larger than, but generally similar in shape to, bead 57. Thus bead 61 has a downward inward slanted top surface 86 disposed at about 10° to the horizontal and a downward outward slanted surface 87 disposed at an angle of about 60° to the horizontal. Again, the shape of bead 61 is subject to some variation and the proportions of the beads 57 and 61 are likewise subject to variation. Bead 61 is at the bottom of the inside of the cap skirt. Preferably slanted surface or flank 87 merges with bottom edge 62. As shown herein, the bead 61 is interrupted in that it has three separate sections 83 (see FIG. 5). However, it will be understood that the number of such sections and the shapes of the bead are subject to variation. Below bead 61 is the bottom edge 62 of cap 49.

Directing attention now to the exterior of the outer skirt of cap 49, below chamber 53 the exterior is formed with thin vertical gripping ribs 89. At the lower end of external vertical surface 66 is a horizontal shoulder or flange 67. There is a rectangular cross-section notch 68 in the top outer corner of flange 67, the purpose of which is to form a line of minimum thickness 91 slanting downward-inward to the intersection of radius 58 and surface 59. When the lower skirt is torn away, as hereinafter explained, the cap skirt fractures at line 91. Because of the angle of line 91 it provides a convenient means for prying the reclosure cap which remains after the lower skirt portion is torn away. Further, the slant of line 91 conceals any frayed edge which is caused by tearing the lower part of the skirt. Below flange 67 is a substantially vertical stretch 69 continuing down to the bottom edge 62.

In a preferred form of the invention, there is an inner skirt or plug 71 spaced inward of surface 56 and having a downward-inward slanted lower corner 72.

Depending from the lower edge 63 is a tear tab 76 here shown as generally rectangular and having a pair of transverse gripping ridges 77 on its inside surface so that the user may grasp the tab 76 when it is desired to open the container. The upper edge of tab 76 on one side curves as shown by reference numeral 78 merging into lower edge 62. The upper edge of tab 76 extends vertically upward to the lower edge 62 and beyond lower edge 62 the interior of the lower skirt portion is formed with a curved score line 79 which merges with the line of minimum thickness 91.

Figure 3:
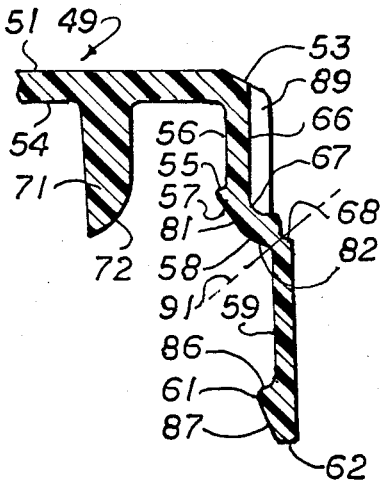
FIG. 3 is an enlarged, fragmentary view of a portion of FIG. 1.
Figure 4:
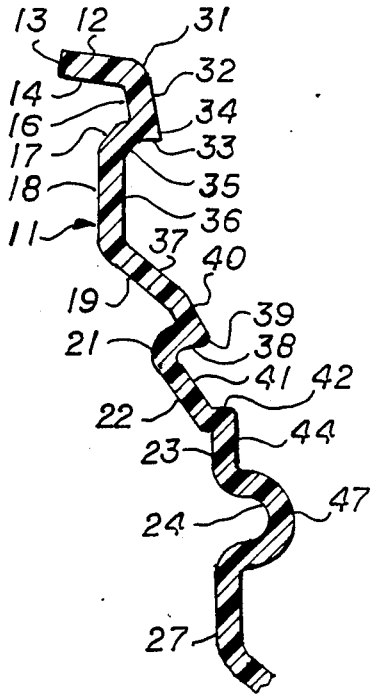
FIG. 4 is a fragmentary cross-section of a portion of a container neck.

Directing attention now to FIG. 3 it will be seen that the interior of the cap 51 assists in properly centralizing the cap relative to the neck 11. The inner end 13 of lip 12 engages the surface 72 of inner plug 71. The curved upper internal bead 57 initially rests on the slanted surface 32 and the underside of the lower internal bead 61 rests on the surface 37. Downward pressure applied to the disk 52 causes the cap 49 to seat on the neck 11. The cap is stretched to enable the bead 57 to lock under the bead 34 and the bead 61 to lock under the bead 39. The slanted surfaces 32 and 37 act as ramps and the slanted surfaces of the bead 57 and 61 slide down the ramp. The lower edge 62 fits flush against the shoulder 42 in the seated position shown in FIG. 4. In the position shown in FIG. 4 it is virtually impossible to remove the cap from the neck without either crushing the neck 11 or so damaging the cap 49 that tampering is evident.

In order to open the container, the user grips the tear tab 76 and tears upwardly along curved score line 79 and then horizontally around the cap for a distance such as to either totally or partially tear away the lower skirt at the line of minimum thickness 91 with result that the bead 61 is disengaged at the shoulder 39. When the lower skirt is thus torn, the consumer may pry up on the curved surface 58 which extends away from the cap and pull the reclosure cap upward so that the bead 57 disengages from the bead 34. As is illustrated, the fact that the surface 36 is spaced inward from surface 59 provides room for the fingers or fingernail to grip under the surface 58. When only part of the contents of the container are dispensed, the reclosure cap (that portion above line 91) may be reseated on the neck 11 as many times as desired.

Figure 8:
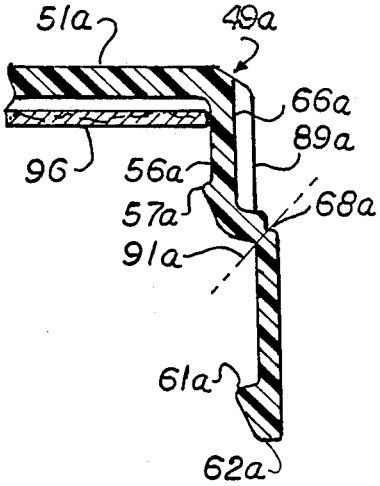
FIG. 8 is a view similar to FIG. 3 of a modified cap.

FIG. 8 illustrates a modification wherein the inner skirt or plug 71 is eliminated. To improve the sealing characteristics of the cap, a liner disk 96 is inserted to underlie the top disk **91*a*. In most respects the cap of FIG. 8** resembles that of the preceding modification and the same reference numerals followed by the subscript a are used to designate corresponding parts.

The seal disc 96 may be of a variety of constructions. Thus a wide variety of seals manufactured by Selig Sealing Products, Inc. may be used. Such seals are laminates of Thin (e.g. 0.001") aluminum foil, Mylar and polyethylene or vinyl or polypropylene Thin foil, Mylar and a proprietary adhesive The preceding laminated with polypropylene or Surlyn.

Products of Insulec are also useful being laminates of

Thin foil, polyester, polyolefin and adhesive

Chipboard, wax, aluminim foil, polyester and adhesive

Chipboard, wax, aluminum foil, adhesive

Polyolefin foam, polyester film, aluminum foil, polyester film and adhesive.

The closure of seal disc depends to a considerable extent on the composition of the neck with which the cap is to be used, the product being packaged and the degree of sealing efficiency required. There are numerous choices of seals.

What is claimed is:

1. In combination, a container neck and a cap for closing said neck, said neck comprising an upper annular upward-inward directed first flange, an outward-downward slanted first stretch terminating in an inward extending first shoulder, said first stretch and said first shoulder defining upper external locking bead means, a downward extending second stretch indented relative to said first stretch, an outward-downward slanted third stretch terminating in an inward extending second shoulder, said third stretch and said second shoulder defining lower external locking bead means, a downward extending fourth stretch indented relative to said third stretch, said second shoulder being offset outward relative to said first shoulder, said cap comprising a top disk, an upper skirt portion depending from said top disk formed with upper internal locking bead means shaped and positioned to engage said upper external locking bead means when said cap is seated on said neck, and having an internal outward extending shoulder, an external outward extending second flange on the lower edge of said upper skirt portion formed with a line of minimum thickness extending at least partially circumferentially around said cap, a lower skirt portion depending from said second flange, and having a diameter larger than said upper skirt portion and formed with lower internal locking bead means shaped and positioned to engage said lower external locking bead means and having an inner wall and a circular intersection with said internal outward extending shoulder, said line of minimum thickness slanting downward-inward to said intersection, tear means on said lower skirt portion, whereby when a user grips and pulls said tear means, said lower skirt portion is torn up to said line of minimum thickness and thence around at least a portion of said line of minimum thickness thereby removing a substantial portion of said lower internal locking bead means from engagement with said lower external locking bead means to permit removal of said cap from said neck.

2. A combination according to claim 1 in which the exterior of said upper skirt portion is substantially vertical and is formed with vertical ribs.

3. In combination, a container neck and a cap for closing said neck, said neck comprising an upper annular upward-inward directed first flange, an outward-downward slanted first stretch terminating in an inward extending first shoulder, said first stretch and said first shoulder defining upper external locking bead means, a downward extending second stretch indented relative to said first stretch, an outward-downward slanted third stretch terminating in an inward extending second shoulder, said third stretch and said second shoulder defining lower external locking bead means, a downward extending fourth stretch indented relative to said third stretch, said second shoulder being offset outward relative to said first shoulder, said cap comprising a top disk, an upper skirt portion depending from said top disk formed with upper internal locking bead means shaped and positioned to engage said upper external locking bead means when said cap is seated on said neck, the exterior of said upper skirt being substantially vertical and formed with vertical ribs, an outward extending second flange on the lower edge of said upper skirt portion, a lower skirt portion depending from said second flange, and having a diameter larger than said upper skirt portion and formed with lower internal locking bead means shaped and positioned to engage said lower external locking bead means, said second flange being formed with a circumferential notch at its upper outer corner, the bottom of said notch having an intersection with the top of said lower skirt portion comprising a first circle, said lower skirt portion having an inner wall which intersects the underside of said outward extending second flange in a second circle, said first circle being larger than and having an elevation higher than said second circle, the section of said cap between said circles comprising a downward-inward slanted zone of weakness, a tear tab fixed to said lower skirt portion, said lower skirt portion being formed with a weakened area adjacent said tab and communicating with said zone of weakness of said second flange, whereby when a user grips and pulls said tear tab, said lower skirt is torn at said weakened area and said zone of weakness is torn, thereby removing a substantial portion of said lower internal locking bead means from engagement with said lower external locking bead means to permit removal of said cap from said neck.

4. A combination according to claim 3 which further comprises a central plug depending from said disk spaced inward from said upper skirt, said first flange of said neck engaging the underside of said top disk and nesting between said plug and said first stretch of said neck and sealing against said disk.

5. A combination according to claim 3 which further comprises a liner seal disk inserted under said disk above said upper internal locking bead means.

6. A combination according to claim 3 in which said lower internal locking bead means is positioned at the bottom of the interior of said lower skirt portion.

* * * * *